US010159324B2

(12) United States Patent
Dinata et al.

(10) Patent No.: US 10,159,324 B2
(45) Date of Patent: Dec. 25, 2018

(54) DEVICE HAVING A SEALABLE CONTAINER FOR A VOLATILE COMPOSITION

(71) Applicant: PT. Kemas Indah Maju Co., Ltd., Jakarta Timur, Jakarta (ID)

(72) Inventors: Nata Kumara Dinata, Jakarta Utara (ID); Goro Kikuchi, Chiba (JP)

(73) Assignee: PT KEMAS INDAH MAJU CO., LTD., Jakarta Timur (ID)

( * ) Notice: Subject to any disclaimer, the term of this patent is extended or adjusted under 35 U.S.C. 154(b) by 0 days.

(21) Appl. No.: 15/654,918

(22) Filed: Jul. 20, 2017

(65) Prior Publication Data

US 2018/0177277 A1 Jun. 28, 2018

Related U.S. Application Data

(60) Provisional application No. 62/439,045, filed on Dec. 25, 2016.

(51) Int. Cl.
*A45D 33/00* (2006.01)
*A45D 33/24* (2006.01)
(Continued)

(52) U.S. Cl.
CPC ..... *A45D 33/008* (2013.01); *A45D 33/006* (2013.01); *A45D 33/24* (2013.01);
(Continued)

(58) Field of Classification Search
CPC .... A45D 33/008; A45D 33/00; A45D 33/003; A45D 33/025; A45D 33/24; A45D 33/16;
(Continued)

(56) References Cited

U.S. PATENT DOCUMENTS 5,102,250 A 4/1992 Gueret
5,611,362 A 3/1997 Duncan et al.
(Continued)

FOREIGN PATENT DOCUMENTS

JP H10-286117 A 10/1998
JP H119335 1/1999
(Continued)

OTHER PUBLICATIONS

International Search Report dated Jan. 12, 2015 for International Application No. PCT/US2014/055353 (aka WO2015/038871), filed Sep. 12, 2014 (2 pages).
(Continued)

*Primary Examiner* — Rachel R Steitz
(74) *Attorney, Agent, or Firm* — Daniel F. Nesbitt; Hasse & Nesbitt LLC

(57) ABSTRACT

A sealable container for a volatile composition for use in a compact case, having a container having an upper rim and outer thread segments, a seal cover having an annular wall having inner thread segments, and an annular seal disposed between the upper rim of the container and a cover plate of the seal cover. The annular seal has an upper seal member having an upper surface, and a lower seal member that registers with the upper seal member and engages the upper rim of the container when the seal covers the container. The upper seal member includes a means for preventing the rotative force applied to the upper surface of the upper seal member when rotating the seal cover to the second rotated position, to be downward onto the lower seal member, to prevent tearing, bunching and deforming of the lower seal member.

20 Claims, 16 Drawing Sheets

(51) Int. Cl.

| | |
|---|---|
| ***A45D 40/22*** | (2006.01) |
| ***B65D 41/04*** | (2006.01) |
| ***B65D 43/16*** | (2006.01) |
| ***B65D 53/02*** | (2006.01) |

(52) U.S. Cl.
CPC ..... *A45D 40/222* (2013.01); *B65D 41/04* (2013.01); *B65D 43/166* (2013.01); *B65D 53/02* (2013.01); *A45D 2200/051* (2013.01)

(58) Field of Classification Search
CPC ..... A45D 40/222; A45D 40/22; A45D 2200/051; B65D 41/64; B65D 43/166; B65D 53/02
See application file for complete search history.

(56) References Cited

U.S. PATENT DOCUMENTS

| | | | | |
|---|---|---|---|---|
| 5,819,764 | A | 10/1998 | Sussman | |
| 5,842,486 | A | 12/1998 | Davis et al. | |
| 5,845,658 | A | 12/1998 | Sussman | |
| 5,950,639 | A | 9/1999 | Suzuki et al. | |
| 5,975,093 | A | 11/1999 | Joulia | |
| 6,199,559 | B1 | 3/2001 | Nikolaus et al. | |
| 6,336,460 | B2 | 1/2002 | Yuhara | |
| 6,345,628 | B2 | 2/2002 | Petit | |
| 6,526,989 | B2 | 3/2003 | Sheffler et al. | |
| 6,923,335 | B2 | 8/2005 | Fujita et al. | |
| 8,231,027 | B2 | 7/2012 | Wang et al. | |
| 8,464,731 | B1 | 6/2013 | Eberlein et al. | |
| 8,678,222 | B2 | 3/2014 | Thorpe et al. | |
| 9,210,984 | B2 | 12/2015 | Byeon | |
| 9,345,306 | B2 | 5/2016 | Thorpe et al. | |
| RE46,854 | E | 5/2018 | Byeon | |
| 2006/0151355 | A1 | 7/2006 | Oh | |
| 2007/0029226 | A1 | 2/2007 | Yuhara et al. | |
| 2011/0020047 | A1 | 1/2011 | Kim | |
| 2011/0266297 | A1 | 11/2011 | Thorpe et al. | |
| 2012/0305442 | A1 | 12/2012 | Apodaca et al. | |
| 2014/0231304 | A1* | 8/2014 | Lee | A45D 33/006 206/581 |
| 2014/0283870 | A1* | 9/2014 | Byeon | A45D 33/006 132/315 |
| 2015/0320174 | A1 | 11/2015 | Kim | |
| 2016/0220007 | A1 | 8/2016 | Montoli | |
| 2016/0280426 | A1 | 9/2016 | Kim | |
| 2017/0006996 | A1* | 1/2017 | Kim | A45D 33/008 |
| 2017/0099930 | A1* | 4/2017 | Kim | A45D 33/008 |

FOREIGN PATENT DOCUMENTS

| | | | |
|---|---|---|---|
| JP | 2000070031 | A | 3/2000 |
| JP | 2002065355 | A | 3/2002 |
| JP | 2004202109 | A | 7/2004 |
| JP | 2008272064 | A | 11/2008 |
| JP | 2008272240 | A | 11/2008 |
| JP | 2008272246 | A | 11/2008 |
| JP | 2012200281 | A | 10/2012 |
| KR | 2020090002238 | A | 3/2009 |
| KR | 101173162 | B1 | 8/2012 |
| WO | 2005013758 | A1 | 2/2005 |
| WO | 2014080965 | | 5/2014 |
| WO | 2015038871 | A1 | 3/2015 |
| WO | 2016003061 | A1 | 1/2016 |

OTHER PUBLICATIONS

Written Opinion of the International Search Authority dated Jan. 12, 2015 for International Application No. PCT/US2014/055353 (aka WO2015/038871), filed Sep. 12, 2014 (9 pages).
International Search Report and Written Opinion dated May 29, 2018 for corresponding International Application No. PCT/IB2017/001702, filed Dec. 23, 2017 (12 pages).

* cited by examiner

DEVICE HAVING A SEALABLE CONTAINER FOR A VOLATILE COMPOSITION

CROSS REFERENCE TO RELATED APPLICATIONS

The present invention claims the benefit of U.S. Provisional Application 62/439,045, filed Dec. 25, 2016, the disclosures of which is incorporated by reference.

BACKGROUND OF THE INVENTION

Historically, cosmetic compacts have been small, flat cases for containing and transporting cosmetic face powder, a powder puff for applying the cosmetic, and a mirror. Typically, compacts were hand sized or smaller cases that could be easily carried in a purse or pocket. Many of these face powders were mineral powders such as talc, often containing mineral pigments. Such mineral powders are typically insensitive to air, containing no components that discolor, decompose, or degrade when exposed to air and containing no volatile materials that could evaporate and damage the consistency of the product. The compacts for such cosmetics were usually flat hinged boxes of various shapes including round, square, oval, or rectangle, consisting of a cover and a base, and had a simple clip holding them closed. While such containers sometimes had a thin paper or plastic seal to prevent the cosmetic from scattering during shipping, this seal was removed and discarded by the consumer before using the cosmetic.

Advances in cosmetic technology and evolutions in packaging have led to the packaging of other types of makeup including eye shadow, lip gloss, rouges, concealers, and new varieties of face powders in small flat containers, some with and some without the associated applicators, and with or without mirrors. All of these containers have been referred to widely as compacts, and many share the same hinged-box construction of the earlier compacts. For the purposes of this patent application, the terms compact and cosmetic case will be used interchangeably to refer to such containers for cosmetics, with or without associated applicators, and with or without a mirror.

Compacts have many advantages, being easy to open and use, convenient to carry, and easy to store and pack. Many of the new cosmetics now being stored and transported in such containers, however, are more sensitive to oxygen, humidity, or air than mineral powders, and cosmetics stored in such containers frequently degrade. Many useful pigments discolor or decompose when exposed to air, and carriers for such pigments frequently contain volatile or air sensitive components. The previous hinged box form of compact is poorly suited for cosmetics containing volatile or air sensitive components. It is desirable, therefore, to provide a compact that retains the advantages of ease of opening and use, convenience of carrying, and ease of storage and packing, while also maintaining a reusable airtight seal to preserve the cosmetics before and between uses. Several attempts have been made to provide an airtight function on a compact, typically by adding additional cover elements inside the compact. In general, providing an airtight function to a container requires either machining the base and the cover of the container from rigid materials to such close tolerances that the fit between the rigid materials leaves no airgaps, or utilizing, flexible or elastomeric materials as seals which can be deformed under pressure to fill any openings between the base and the cover. In some designs, a separate inside container is provided, consisting of a cover and a base containing the cosmetic, the inside container fitting into the base of the compact and providing an airtight seal around the cosmetic. In use, the consumer must open first the cover of the compact and then the cover of the inside container to access the cosmetic, and close first the container cover and then the compact cover to store. To maintain the seal on the inside container, the compact lid is provided with either a thread or bayonet-like cam design which locks onto the compact base and applies pressure to the cover of the inside container.

On other airtight compacts, the airtight function is achieved by providing an internal smaller cover that interacts with the base of the compact. In some examples, a flat gasket is pressed between the internal cover and the base to provide an airtight seal. Other examples provide a peripheral gasket such as an O-ring that interacts with a matching element on the base. Still other examples act by pressing a lip molded underneath the internal cover against the base. Similar to examples having a separate inside container, the internal cover is kept in place by the compact cover pressing down on the inside lid and locking on the base by either a thread or a bayonet like cam design. Like compacts with a separate inside container, compacts with internal covers require opening both the compact cover and an interior cover before the cosmetic container can be accessed, and closure of both an interior cover and the compact cover are required for airtight storage.

It is believed that the machined and molded sealing surface of a container and seal cover of a conventional cosmetic compact has an uneven surface microscopically with scratches and cracks that are challenging to seal, and that the use of conventional seal rings and gaskets cannot provide a completely effective seal system to prevent the volatile components from escaping the cosmetic composition/through the seal surfaces between the container and the cover, resulting is volatile component loss sufficient to deteriorate the quality of the volatile compact composition in just a few weeks.

US 2016/0220007 A1, published Aug. 4, 2016, the description of which is incorporated by reference in its entirety, describes a cosmetic case comprising a container having a wall that defines a recess for a cosmetic composition, and a cover assembly consisting of a ring that is free to rotate about the wall and retained by the container, and a cover having a hinge that affixes the cover to the ring. Mating threads on the cover can engage threads on the container so that rotation of the cover assembly draws a sealing gasket inside the cover towards the container rim to form an airtight seal.

However, the same cosmetic case and additional features had been described in Japanese Application 2000-070031, published Mar. 7, 2000, which was granted as Japanese Patent 3,571,931, the descriptions of which are incorporated by reference in their entirety, where a seal member is fixed to the inner surface of the lid member or a top portion of the container wall.

Nevertheless, there remains a need to provide an improved cosmetic case that provides better sealing for volatile cosmetic products.

SUMMARY OF THE INVENTION

The present invention provides a compact case with a sealable container for a volatile composition.

The present invention provides a sealable container for a volatile composition containing a volatile component that can be used in a compact case.

In an embodiment of the invention, the sealing of the container with the lid of the sealable container is accomplished by threadedly engaging the lid with the container, and the lid of the sealable container is covered and uncovered from the container with a hinge means.

In another embodiment of the invention, the sealable container is replaceable, including insertable and removable, within the compact unit.

In an embodiment of the invention, the sealable container includes a sealing system that includes a circular seal disk disposed between an upper rim of a threaded container and an inside lower surface of a seal cover or lid that threadedly covers the upper rim of the container, and an annular seal material disposed between the annular periphery of the circular seal disk and the annular upper rim of the container. The upper surface of the circular seal disk is configured to remain stationary to allow the inside lower surface of the seal cover to slide rotatively, and relatively, over the stationary upper surface of the circular seal disk. The stationary circular seal disk protects a second seal material, disposed between the upper rim of the container and the under surface of the circular seal disk, from shear forces resulting from the seal cover being threadedly rotated onto the container.

In another embodiment of the invention, a sealable container for a volatile composition is provided for a compact case that includes: i) a container including an annular outer wall, and a floor that define a container space for a volatile composition, and the outer wall having an upper rim, an outer surface and including a series of outwardly-extending thread segments; ii) a hinged ring comprising an annular wall having a lower rim, and a hinge support extending from a portion of said annular wall, and the hinged ring is configured to rotate relative to the container; iii) a seal cover including a cover plate and an annular wall having an inner surface and including a series of inwardly-extending thread segments, and a hinge member extending from a portion of said annular wall to hingedly engage the hinge support of the hinged ring to pivot the seal cover between an uncovered position and a covering position, and wherein at the covering position the seal cover is a first rotated position relative to the container, and the seal cover and the hinged ring can be rotated relative to the container, between the first rotated position at which the thread segments of the seal cover are not engaged with the thread segments of the container, and a second rotated position at which the thread segments of the seal cover are engaged with the thread segments of the container to threaded draw the cover plate axially toward the upper rim of the container to a sealing position; and iv) an annular seal disposed between the upper rim of the container and the cover plate of the seal cover, for forming a sealable container for the volatile composition when the seal cover is threadedly drawn over the container to the sealing position, the annular seal including an upper seal member having an upper surface and a lower surface having an outer periphery, and a lower seal member that registers within the outer periphery of the lower surface of the upper seal member, and configured to engage the upper rim of the container in the covering position of the seal cover, the upper seal member including a means for preventing rotative force applied to the upper surface of the upper seal member when rotating the seal cover to the second rotated position, to be exerted to the lower seal member.

In another embodiment of the invention, a compact device has a sealable container for a volatile composition. The compact device includes: i) a lower base having an annular frame and an annular track concentric with and surrounding the annular frame; ii) a container that is securable within the annular frame of the lower base, the container including an annular outer wall, and a floor that define a container space for a volatile composition, and the outer wall having an upper rim, an outer surface and including a series of outwardly-extending thread segments and an annular rib extending from the outer surface of the outer wall; iii) a hinged ring comprising an annular wall having a lower rim, and a hinge support extending from a portion of said annular wall, and the hinged ring is configured to rotate the lower rim of the annular wall within the annular track of the lower base; iv) an seal cover including a cover plate and an annular wall having an inner surface and including a series of inwardly-extending thread segments, and a hinge member extending from a portion of said annular wall to hingedly engage the hinge support of the hinged ring to pivot the seal cover between an uncovered position and a covering position, and wherein at the covering position the seal cover is a first rotated position relative to the container, and the seal cover and the hinged ring can be rotated relative to the container, between the first rotated position at which the thread segments of the seal cover are not engaged with the thread segments of the container, and a second rotated position at which the thread segments of the seal cover are engaged with the thread segments of the container to threaded draw the cover plate axially toward the upper rim of the container to a sealing position; and v) an annular seal disposed between the upper rim of the container and the cover plate of the seal cover, for forming a sealable container for the volatile composition when the seal cover is threadedly drawn over the container to the sealing position, the annular seal including an upper seal member having an upper surface and a lower surface having an outer periphery, and a lower seal member that registers within the outer periphery of the lower surface of the upper seal member, and configured to engage the upper rim of the container in the covering position of the seal cover, the upper seal member including a means for preventing rotative force applied to the upper surface of the upper seal member when rotating the seal cover to the second rotated position, to be exerted onto the lower seal member.

In an embodiment of the means for preventing rotative force, the upper surface of the upper seal, member has high rotative slippage, and low rotative friction, between the seal cover and the upper seal member, which prevents the rotating seal cover from rotating the upper seal member, and thereby eliminating any circumferential shear force upon the lower seal member. In one embodiment, the upper seal member is made of a thermoplastic material that has a low coefficient of friction, and is preferably has a smooth upper surface.

In another embodiment of the means for preventing rotative force, the sealable container can include a slippage sheet disposed between the upper surface of the upper seal member, where the slippage sheet comprises a slippage material or surface coating having a high rotative slippage, and low rotative friction, to prevent the rotating seal cover from rotating the upper seal member, thereby eliminating any circumferential shear force upon the lower seal member. In one embodiment, the slippage sheet is made of a low-friction, non-stick and durable material. Examples of the slippage sheet material or coating is a synthetic fluoropolymer, such as polytetrafluoroethylene (TEFLON™).

In another embodiment of the means for preventing rotative force, the upper seal member includes a plurality of projections that engage and bayonet into a plurality of slots formed into an annular flange of the upper rim of the container, to prevent the rotating seal cover from rotating the upper seal member, and thereby eliminating any circumferential shear force upon the lower seal member. When the seal cover is threadedly closed over the threaded container, the upper seal member and its upper surface remain stationary, held in place against rotation by the slot in the upper rim of the container retaining the projections of the upper seal member. This allows the inside lower surface of the seal cover to slide rotatively, and relatively, over the stationary upper surface of the upper seal member, and protects the lower seal material, which is disposed between the upper rim of the container and the under surface of the upper seal member, from shear forces resulting from the seal cover being threadedly rotated onto the container.

In an embodiment of the invention, the lower base includes an annular inner tray disposed outerward radially of the hinged ring, the inner tray having a slot within which the hinge support of the hinged ring can rotate relative to the container between die first rotated position and the second rotated position.

In an embodiment of the invention, the container and the upper seal member are made of a resilient thermoplastic material, which can be selected from the group consisting of polypropylene (PP) high-density polyethylene (HDPE), polyethylene terephthalate (PET), polyethylene terephthalate-glycol modified (PTG or PETG), and an impact-modified acrylonitrile-methyl acrylate copolymers, available under the tradename BAREX®.

In an embodiment, the lower seal member is made of a silicon material, a urethane material, or a rubber material that can include nitrile rubber (NBR), and is preferably a pliable or elastic material that can elastically conform to a seal surface of the upper rim of the container and the upper seal member.

In an embodiment of the invention, the compact device further includes an upper outer cover that is hinged to the lower base, to cover the sealable container.

In an embodiment of the invention, wherein the lower base, the container, the hinged ring, the seal cover, and the annular seal each have a rotative centerline that align with a common centerline.

In an embodiment of the invention, the series of outwardly-extending thread segments are separated by a corresponding series of gaps, wherein the series of inwardly-extending thread segments of the seal cover are angularly aligned with series of gaps when the seal cover is in the covering position, and the seal cover and the hinged ring are in the first rotated position relative to the container, and are angularly aligned with the series of outwardly-extending thread segments when the seal cover and the hinged ring are in the second rotated position relative to the container.

DETAILED DESCRIPTION OF THE INVENTION

Figure 1A:
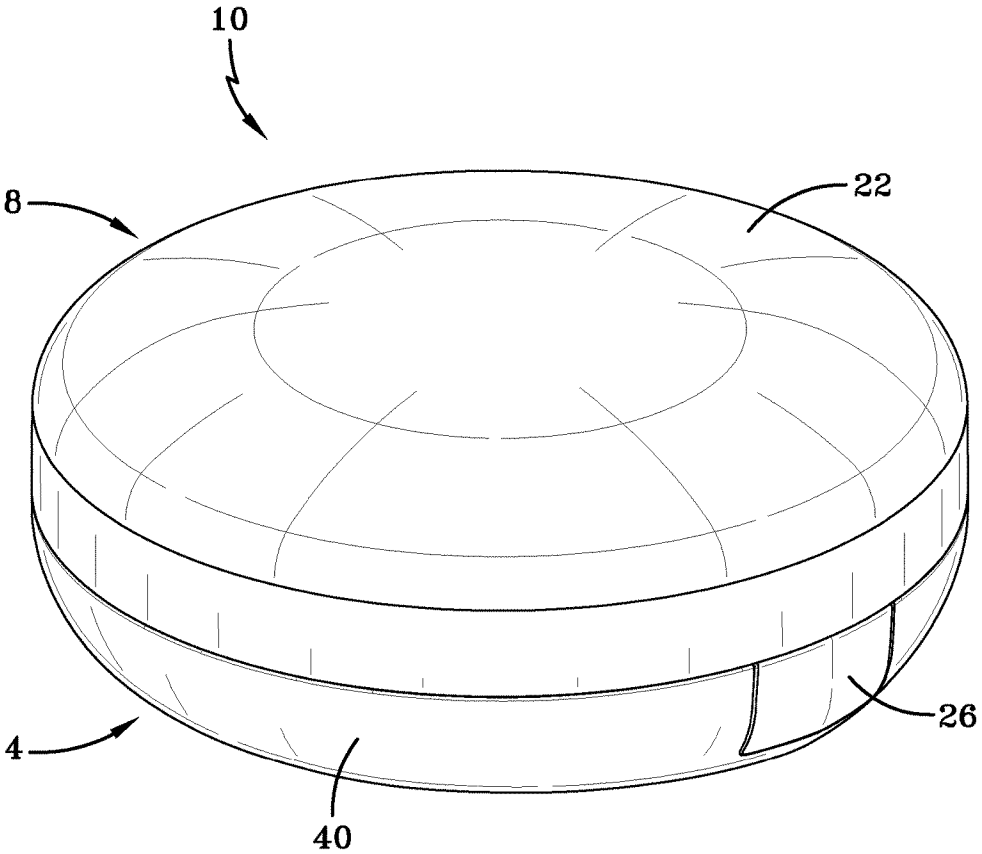
FIGS. 1*a* and 1*b* show a compact case having a replaceable sealable container for a volatile composition.
Figure 1B:
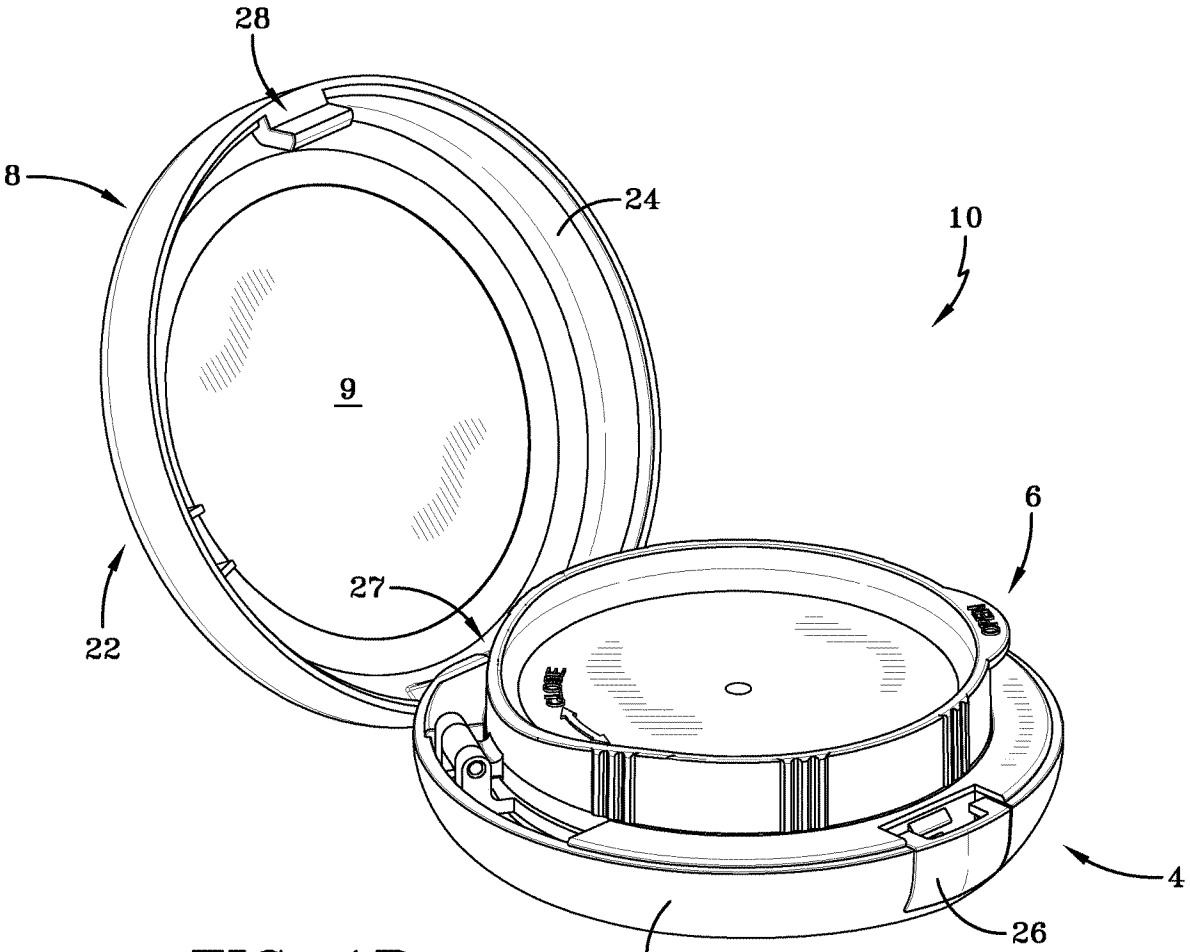

FIGS. 1*a*, 1*b*, 2 and 3 show a compact 10 including a lower base unit 4 that hinges and clasps to an upper cover unit 8 to form a case, and a replaceable sealable container 6 for a volatile composition. The lower base unit 4 has a push-button 26 that includes a catch 48 on the upper cover 22 to form an opening means 47 for the upper cover 22. The lower base unit 4 also includes a hinge means 45 that cooperates with a hinge means 27 of the upper cover 22 to pivot the upper cover 22 between an open position shown in FIG. 1*b*, and a closed position shown in FIG. 1*a*.

Figure 3:
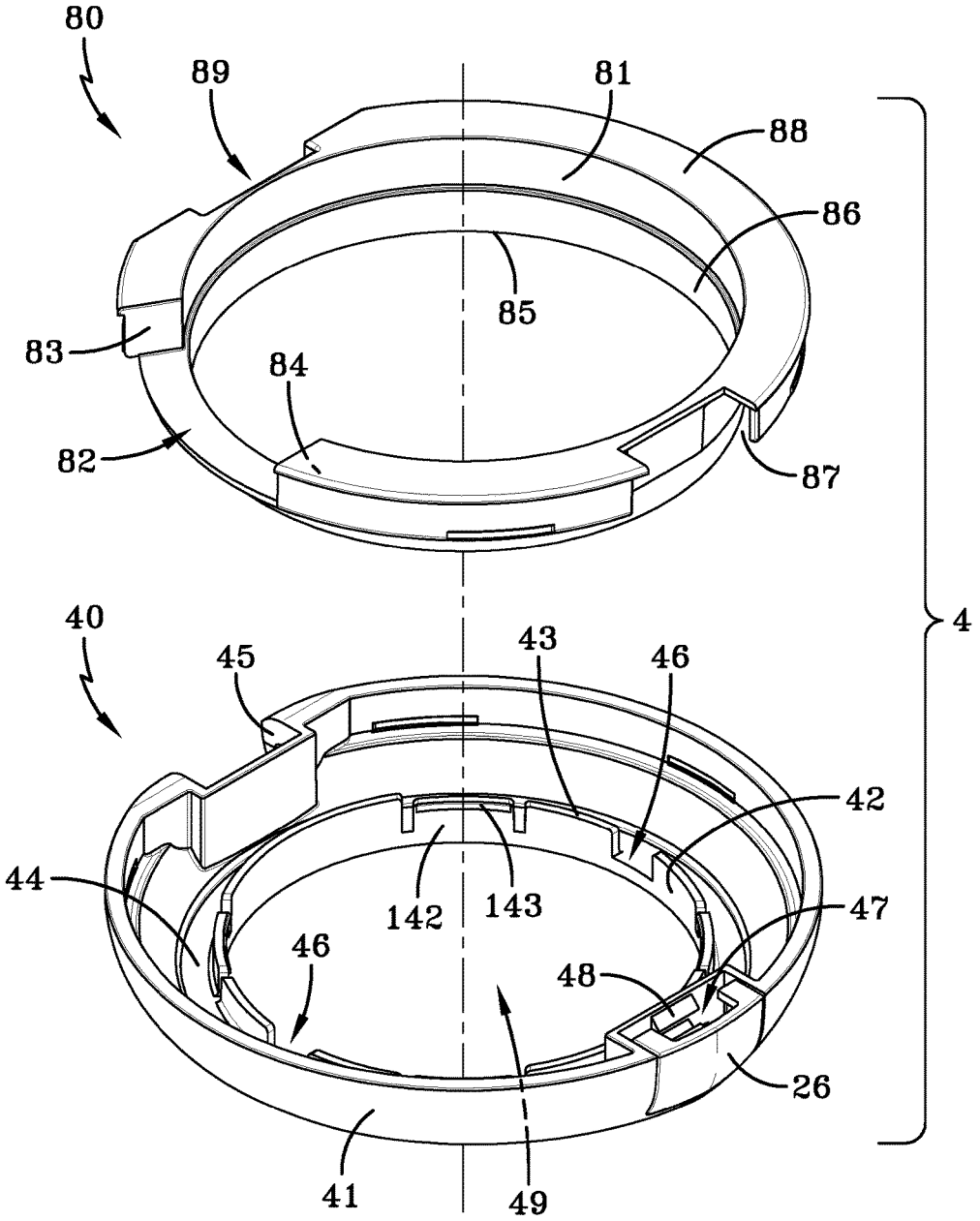
FIG. 3 shows an exploded view of the lower base unit.

FIG. 3 shows an exploded view of the lower base unit 4 that includes a lower base 40, and an inner tray 80 including an upper annular segment including an inner wall 81 and top surface 88, and a lower wall 86 having a lower edge 85. The lower base 40 includes an outer wall 41 and in inner annular frame 42 that includes an upper rimmed edge 43 and a slot 46. The sealable container 6 includes container 50 of the volatile composition, and a hinged, rotatable lid 70 that seals a top opening of the volatile composition container 20. The sealable container 6 is held in the annular frame 42 of the lower base 40. When the sealable container 6 is inserted down into the opening of the annular frame 42, an annular side rib 59 of the container 50, shown in FIG. 4, engages and is supported on the upper edge 43 of the frame 42 of the lower base 40. A post 56 on the container 50, below the annular side rib 59, aligns with and extends radially outwardly into the slot 46 of the frame 42 to prevent axial rotation of the container 50 while retained by the annular frame 42 of the lower base 40.

Figure 5:
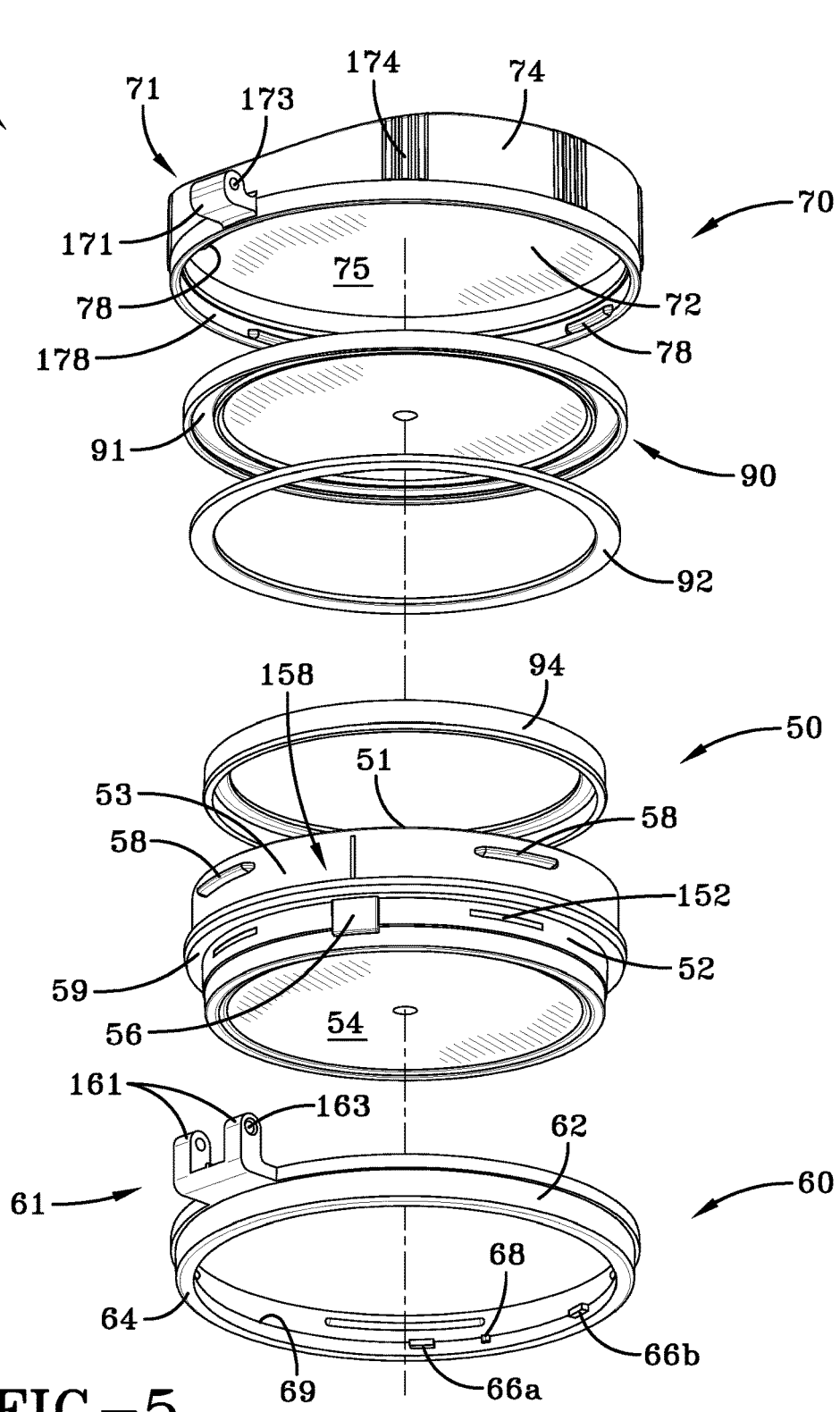
FIG. 5 shows an exploded bottom view of the components of the sealable container.

As shown in FIGS. 3 and 5, the frame 42 includes an inwardly extending ledge 143 at the upper rimmed edge 43 of a segment 142 that extends radially inwardly. When the container 50 is being inserted down into the frame 42, the outer surface of the lower wall 52 of the container 50 biases the ledge 143 and the wall segment 142 radially outwardly, until the ledge 143 drops into a recessed slot 152 in the lower wall 52 of the container 50, to retain the container 50 in its inserted position within the lower base 40.

Figure 2:
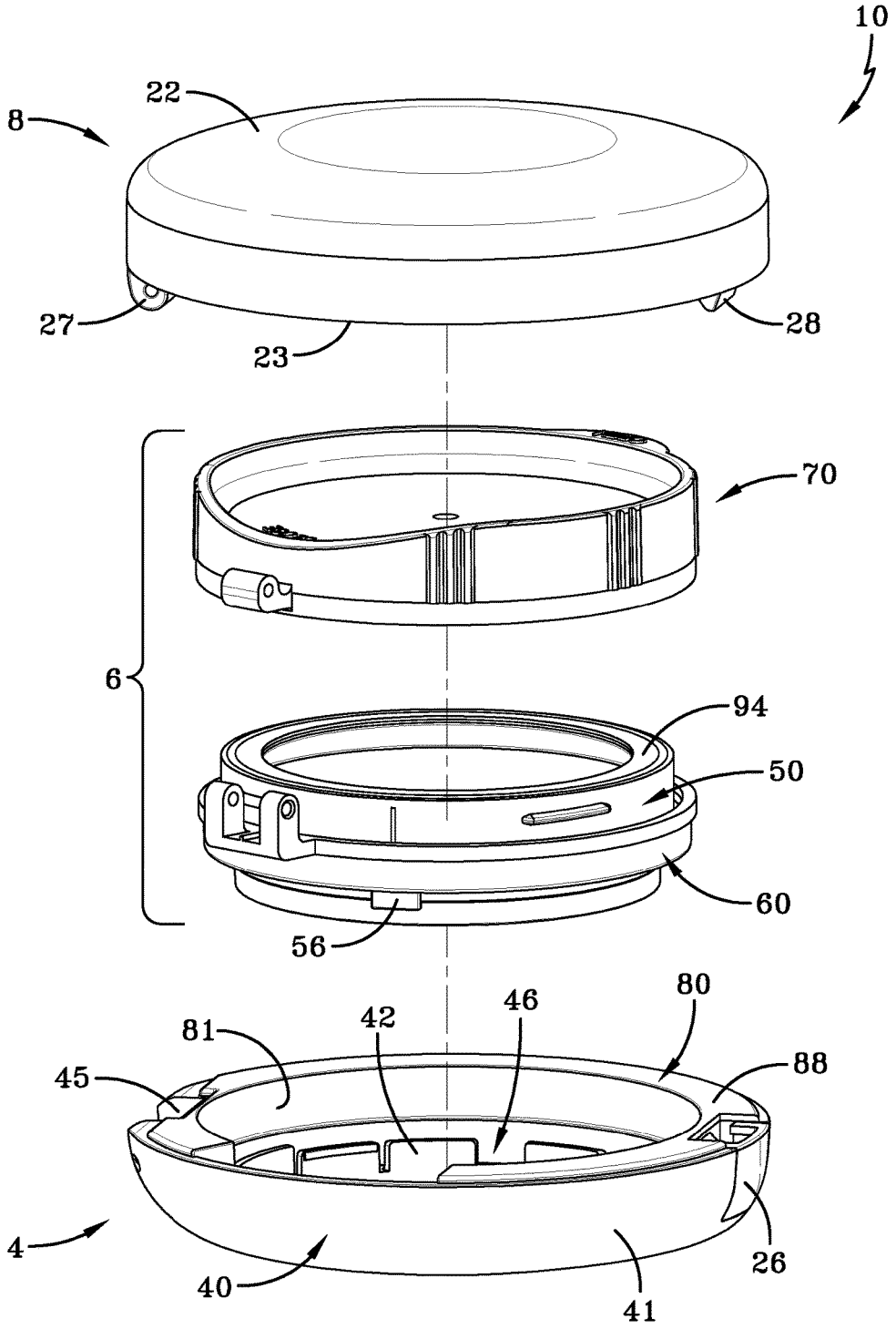
FIG. 2 shows an exploded view of the compact case have a lower base unit that hinges to an upper cover unit, and the sealable container having a hinged, rotatable lid that seals the volatile composition container.

As shown in FIGS. 1*a* and 2, the upper cover 22 includes an annular wall 24 having a lower rim 23, a hinge means fixed on one side of the annular wall 24, and the latch 28 for securing to a catch 48 of the lower base 40 to close the upper lid 22 over the lower base unit 22 as shown in FIG. 1*a*. The push button 26 is biased radially outwardly. When the push button 26 is depressed inwardly, a post on the inside of the push button 26 biases the catch 48 inwardly, thereby releasing the latch 28. The upper cover 22 can also include a mirror 9 fixed to an inner surface.

As shown in FIG. 3, the inner tray 80 has a hinge relief section 89 formed into the upper segment to receive the hinge means 45 of the lower base 40, and a catch relief section 87 formed into the upper segment to expose the opening means 47 and push button 26 of the lower base 40.

Figure 4:
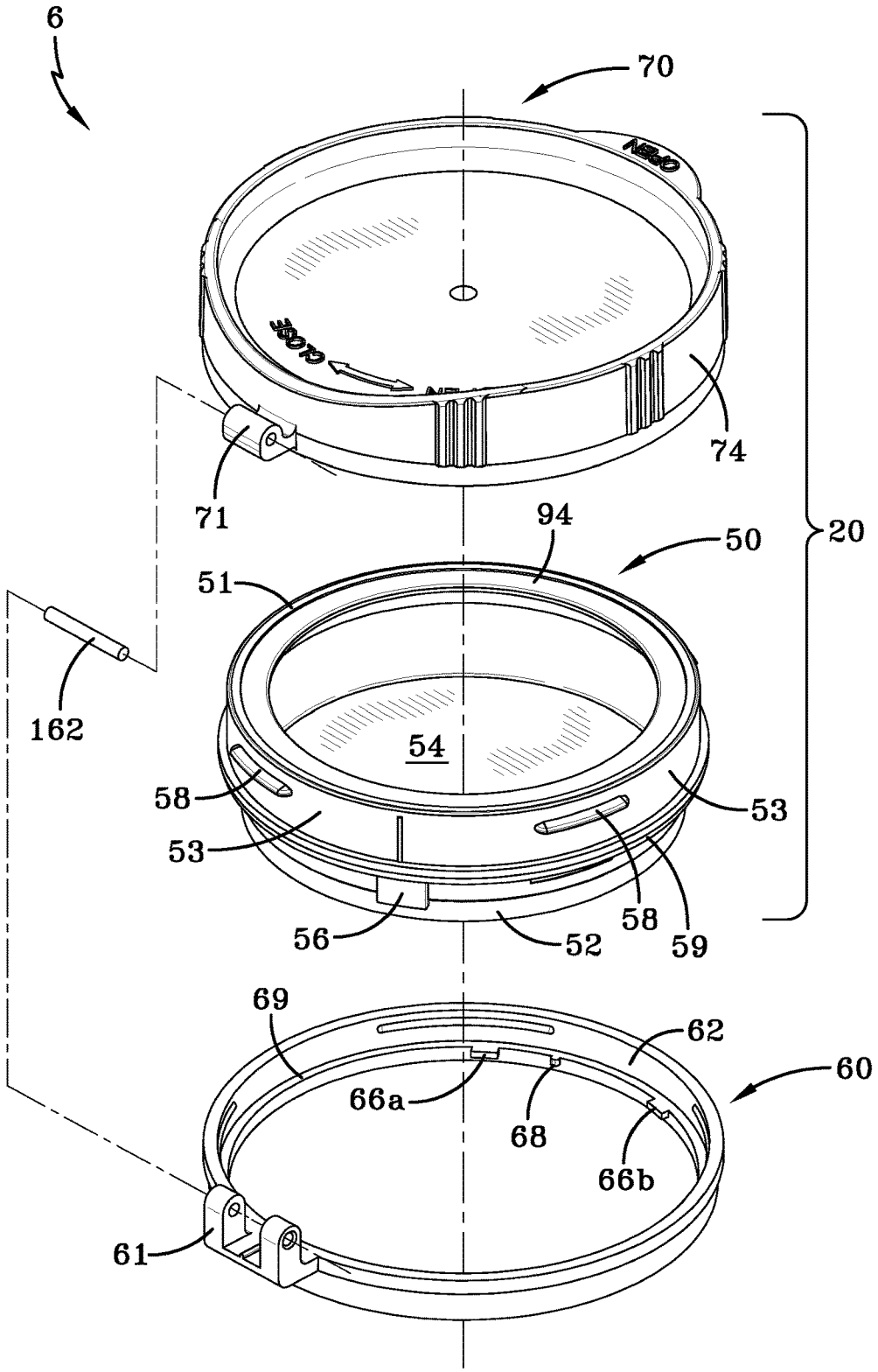
FIG. 4 shows an exploded top view of main portions of the sealable container.
Figure 6:
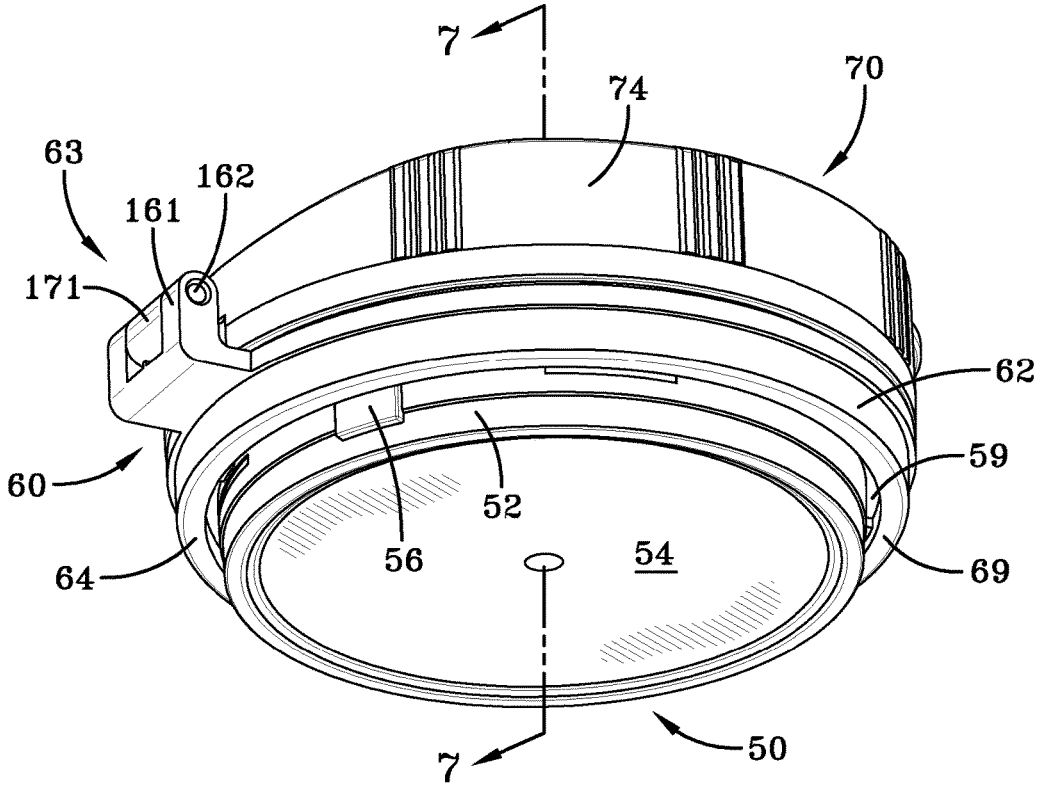
FIG. 6 shows a view of the sealable container with the hinged lid in a position covering the top of the container.

FIGS. 4, 5 and 6 show the sealable container 6 and its portions and components. A volatile component container 50 includes an annular wall, and a bottom 54, the annular wall including a lower wall 52 and an upper wall 53. The annular rib 59, discussed above, extends from the annular wall and separates the lower wall 52 from the upper wall 53. The upper wall 53 includes a plurality of outwardly-extending thread segments 58 distributed evenly around the circumference. Each of the thread segments 58 align along a helical or slanted path, and define an arcuate space 158 between the successive thread segments 58. The length of the plurality of thread segments 58 can be short relative to the arcuate spaces 158.

The container 50 also has a circular upper rim 51 having a narrow, annular, planar upper surface that defines a seal surface that requires sealing to prevent the escape of volatile components from the volatile compact composition within the container 50.

The seal cover or lid 70 is configured to be threadedly secured to the top opening of the container 50 to close and seal against the upper rim 51 of the container 50. The seal cover 70 includes a cover plate 72 with an inside surface 75 and an outer surface, and an annular wall 74. The annular wall 74 extends downward from the periphery of the cover plate 72. A plurality of projections 174 are disposed on the outer surface of the wall 74 to provide a gripping means for a user to grasp and rotate the seal cover 70. The wall 74 also includes a plurality of inwardly-extending thread segments 78 distributed evenly around the circumference. Each of the thread segments 78 align along a helical or slanted path, and define an arcuate space 178 between the successive thread segments 78. The length of the plurality of thread segments 78 can be short relative to the arcuate spaces 178.

Figure 8:
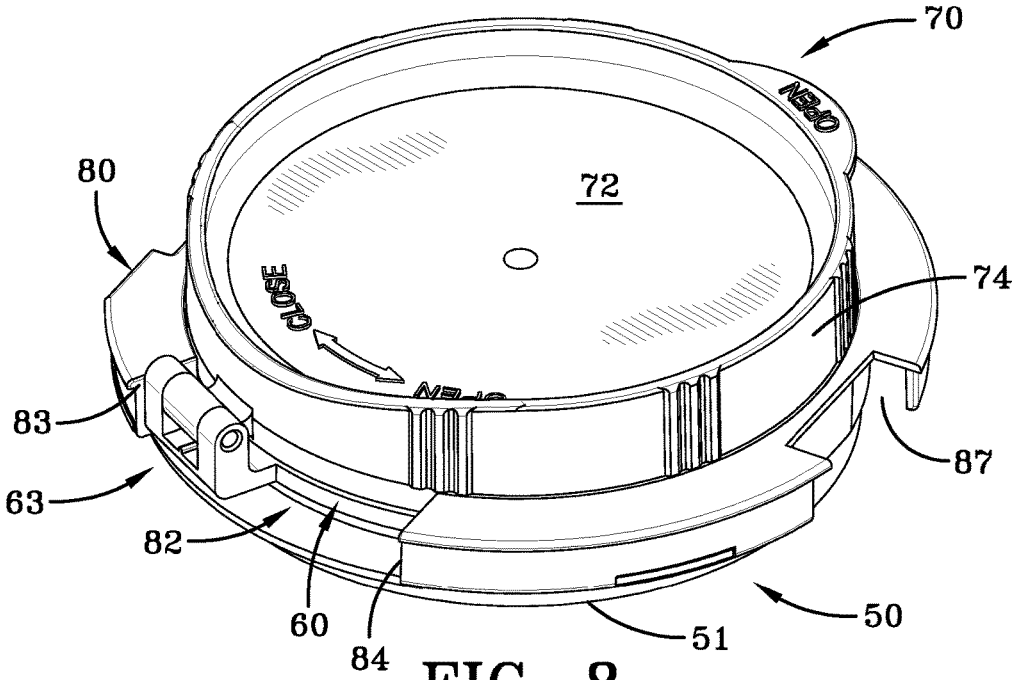
FIG. 8 shows a top view of the sealable container with the hinged lid in a covered position and in a rotated position where the lid is threaded engaged with the container.

The thread segments 78 of the seal cover 70 are congruent with the thread segments 58 of the container 50, so that when the seal cover 70 is placed over the top opening of the container 50 in the first rotated position illustrated in FIG. 8, the thread segments 78 of the seal cover 70 register circumferentially with the spaces 158 between successive thread segments 58 of the container, and thread segments 78 of the seal cover 70 are not engaged with the thread segments 58 of the container 50. The thread segments 78 on the inner surface of the wall 74 are positioned axially to place the thread segments 78 axially below the thread segments 58 of the container 50, so that when the seal cover 70 is rotated relative to the container 50 to the second rotated position illustrated in FIG. 9, the thread segments 78 engage the underside of the thread segments 58 of the container 50, causing the seal cover 70 to draw downward axially over the upper rim 51 of the container 50 to the sealing position.

Figure 9:
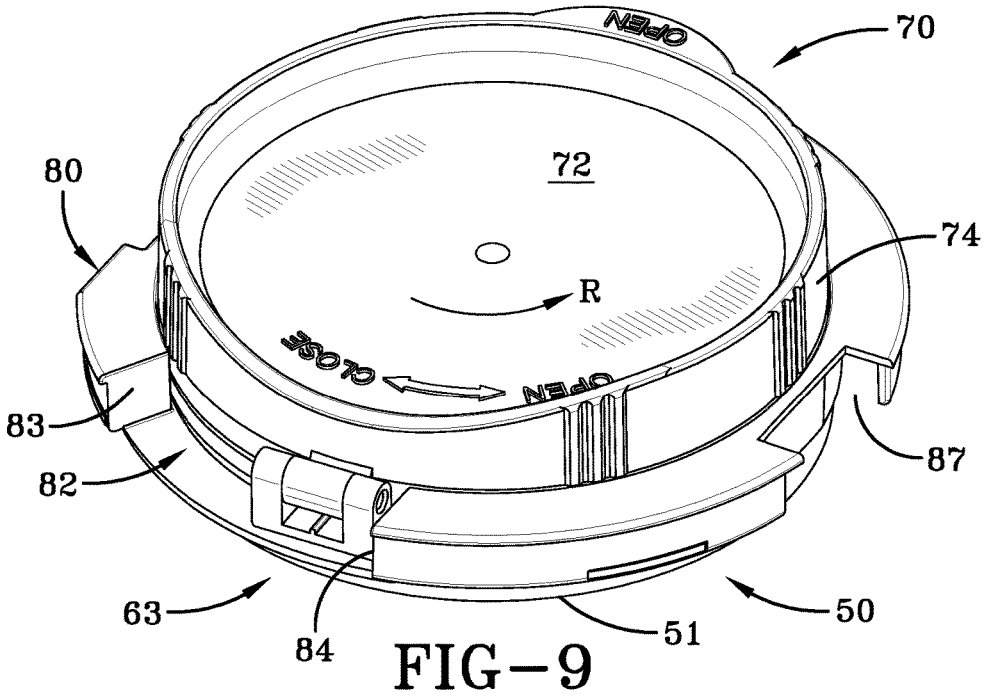
FIG. 9 shows the sealable container of FIG. 8 where the hinged lid has been rotated to a position where the lid is not threaded engaged with the container.

FIGS. 8 and 9 also show the inner tray 80, for clarity, separated from the lower base unit 40, and associated with sealed container 20. The inner tray 80 also has an arcuate slot 82 formed into the inner wall 81 and the top surface 88 of the upper segment, to define a first slot face 83 and a second slot face 84. The slot 82 provides an arcuate space for the container hinge 63 to pivot between its first rotated position adjacent the first slot face 83, as shown in FIG. 8, and its second rotated position adjacent the second slot face 83, as shown in FIG. 9.

Figure 7A:
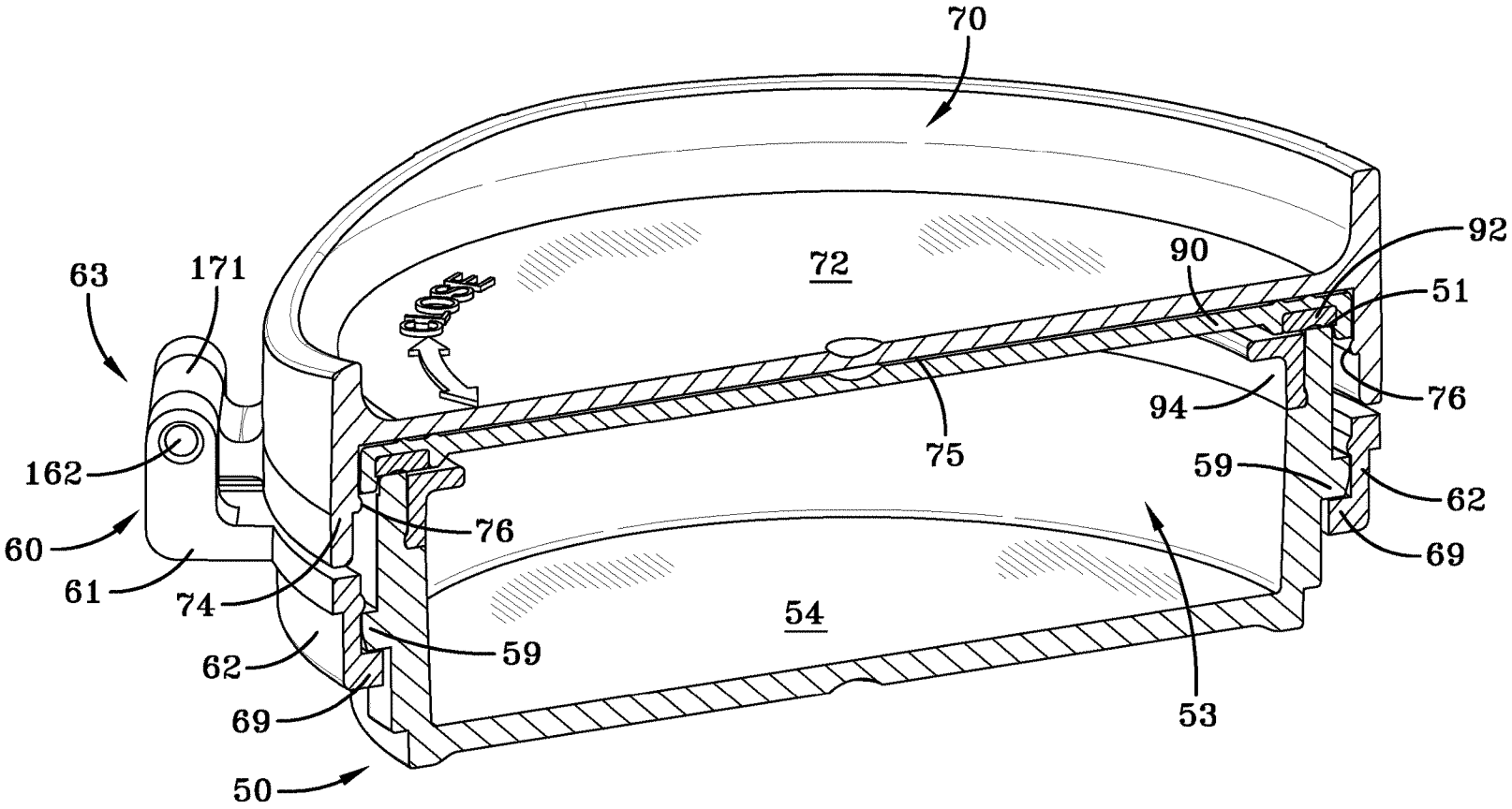
FIG. 7A shows a sectional view of the sealable container viewed through line 7-7 of FIG. 6.
Figure 7B:
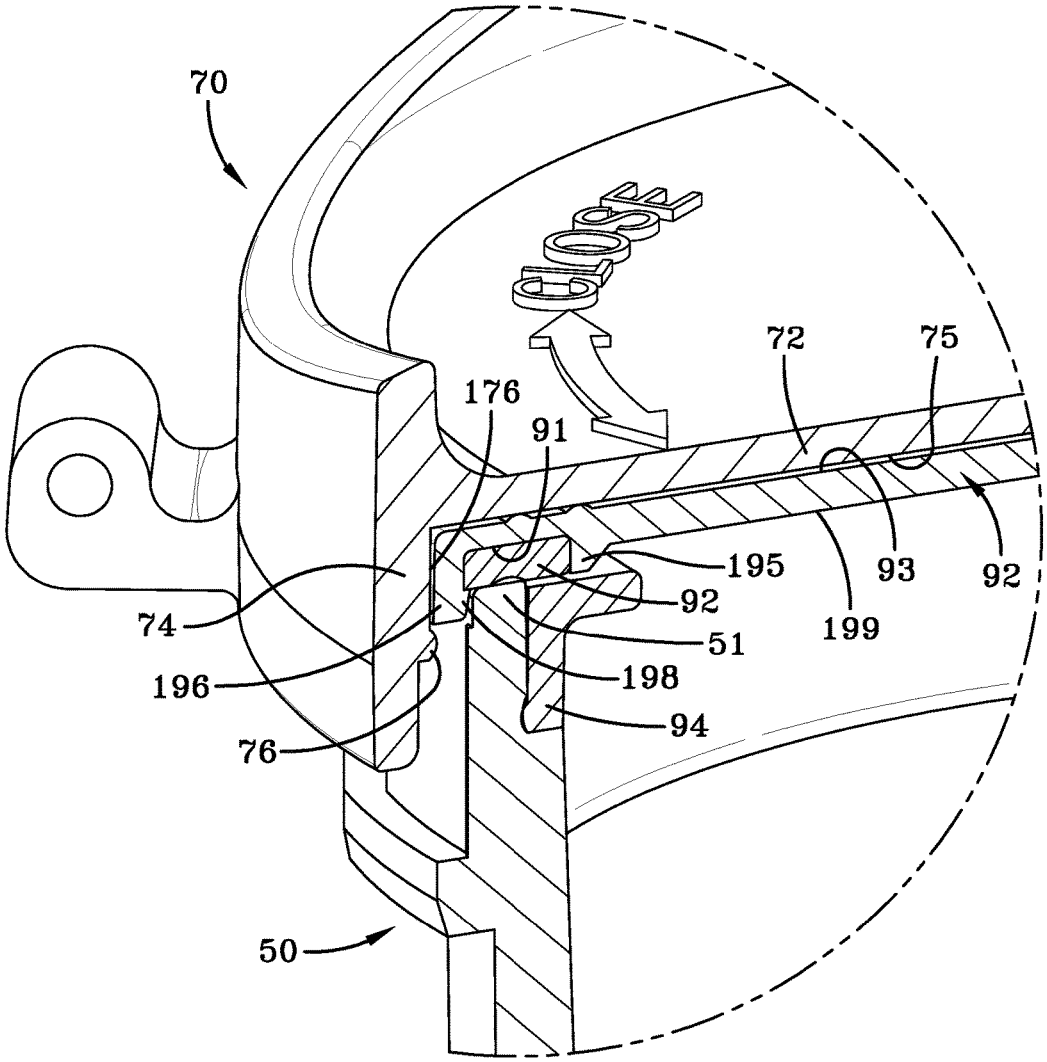
FIG. 7B shows a sectional view of the sealable container of FIG. 7A.

The sealed container 6 includes a seal system disposed between the upper rim 51 of the container 50 and the inside surface of the cover plate 72 of the seal cover 70. An effective sealing of the container 50 inhibits or prevents a volatile solvent of the cosmetic composition in the container space 55 from escaping over time. Excessive loss of solvent can result in a thickening, hardening or drying of the cosmetic composition. The seal system uses a sealant material that has low vapor diffusivity and conforms to the seal surfaces of the container 50 and the seal cover 70. As shown in FIGS. 5, 7A and 7B in a first embodiment of the invention, the threaded seal system includes an annular upper seal member 90 having an outer periphery, and a lower seal member 92 that registers within the outer periphery of the upper seal member 90. In the illustrated embodiment, the upper seal member 90 is a circular disk, typically made of a resilient thermoplastic material, preferably having low vapor diffusivity. The seal cover 70 also includes an annular inner rib 76 that extends a minimal distance radially inwardly away from the inner surface of the wall 74, and a fixed axial distance from the inner surface 75 of the cover plate 72 to define an annular groove 176 there between, as shown in FIG. 7B. An annular outer flange 196 of the upper seal member 90 is retained rotatably within the groove 176 of the seal cover 70 by the annular rib 76, so that the upper seal member 90 remains with the seal cover 70 during product use.

The annular outer flange 196 itself includes an annular ledge 198 projecting inwardly from its lower edge, and a second ridge 195 extending from an wider surface 199 of the upper seal member 90 to define a flat annular flat groove 91. The peripheral edge of the lower seal member 92 is retained within the groove 91 by the annular ledge 198.

The sealable container also includes a sponge ring 94 for retaining a sponge applicator within the container 50.

A feature of the upper seal member 90 is an upper surface 93 that confronts against the inner surface of the seal cover 70. The upper surface 93 has a minimal frictional interface that allows the cover plate 72 to rotatably slip or slide relative to the upper seal member 90. When the inner surface 75 of the plate 72 of the seal cover 70 is threadedly rotated onto the upper rim 51 of the container 50, the upper rim 51 of the container 50 exerts a vertical upward compressive force on the lower seal member 92, which presses the seal member 92 into the groove 91 of the upper seal member 90, and the inside surface 75 of the plate 72 of the seal cover 70 exerts both a vertical downward compressive force and a circumferential (rotative) shear force against the upper surface 93 of the upper seal member 90. The peripheral groove 91 of the upper seal member 90 engages with the lower seal member 92. To avoid the circumferential (rotative) shear force from acting on the lower seal member 92, the low coefficient of friction of the upper surface 93 of the upper seal member 90 effects relative rotational slippage between the upper surface 93 of the upper seal member 90 and the inner or lower surface 75 of the cover plate 72. This prevents the upper seal member 90 from rotating with the rotating seal cover 72, and thereby eliminates any circumferential shear force upon the lower seal member 92, which prevents tearing, bunching and deforming of the lower seal member 92.

In an embodiment of the invention, the lower seal member 92 is an annular ring of sealant material, and in an alternative embodiment a circular disk. The lower seal member 92 can be a silicone material, a urethane seal material, or a rubber material that can include nitrile rubber (NBR), which have sufficient seal properties and pliability to form an effective vapor-proof seal against both the upper rim 51 of the container 50 and the upper seal member 90, and to seal in the volatile components of the cosmetic composition when the seal cover 70 is threaded down and over the container 50.

The plastic material of the container 50 and the upper seal member (or disk) 90 is preferably a thermoplastic material having a low vapor diffusivity, to minimize loss of volatile solvents and other volatile components through the bodies of the container 50 and upper seal member 90 by diffusion. The seal system provides a compact product that can minimize solvent and other volatile component loss and maintain the quality of the composition for much longer times than can a conventional compact.

In the illustrated embodiment, the upper seal member and the lower seal member are distinct parts, configured to cooperate to form a seal component of the threaded seal system. In another embodiment, the upper seal member and the lower seal member can be manufactured as an integral part. For example, the material of the lower seal member can be over-molded onto a molded upper seal member, by well-known means.

A further component of the seal container 6 is a hinged ring 60. The hinged ring 60 includes an annular wall 62 and a hinge support 61 extending from a portion of the wall 62. The hinge support 61 associates with the hinge member 71 of the seal cover 70 to form a container hinge 63. In the illustrated embodiment, the hinge support 61 includes a pair of laterally spaced-apart support lugs 161 with a lateral bore 163 through each support lug 161, and the hinge member 71 includes an extending lid lug 171 with a lateral bore 173 there through. A pin 162 is press-fit through bores 163 of each of the pair of support lugs 161 and the bore 173 of the lid lug 171 to form the pivoting hinge 63 of the seal cover 70 relative to the hinged ring 60.

Figure 10:
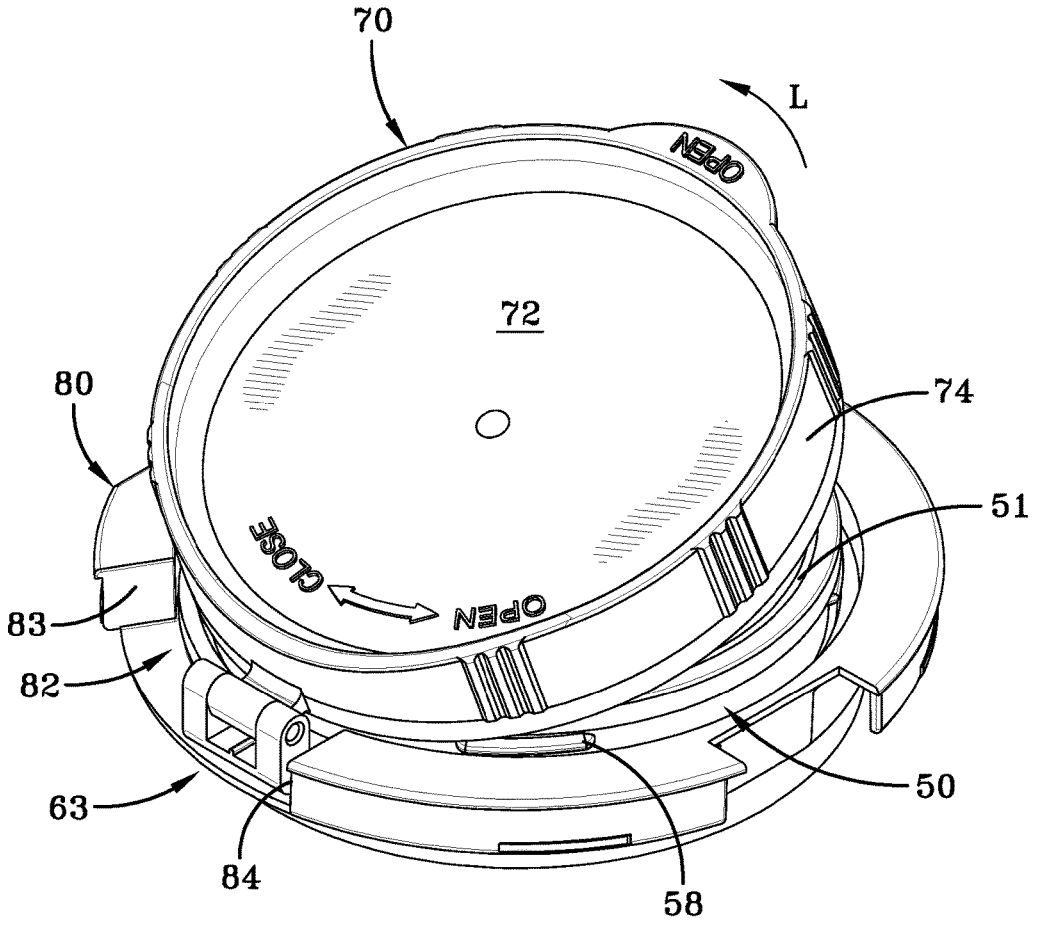
FIG. 10 shows the sealable container of FIG. 9 where the hinged lid has been lifted from the covered position toward an uncovered, open, position.
Figure 11:
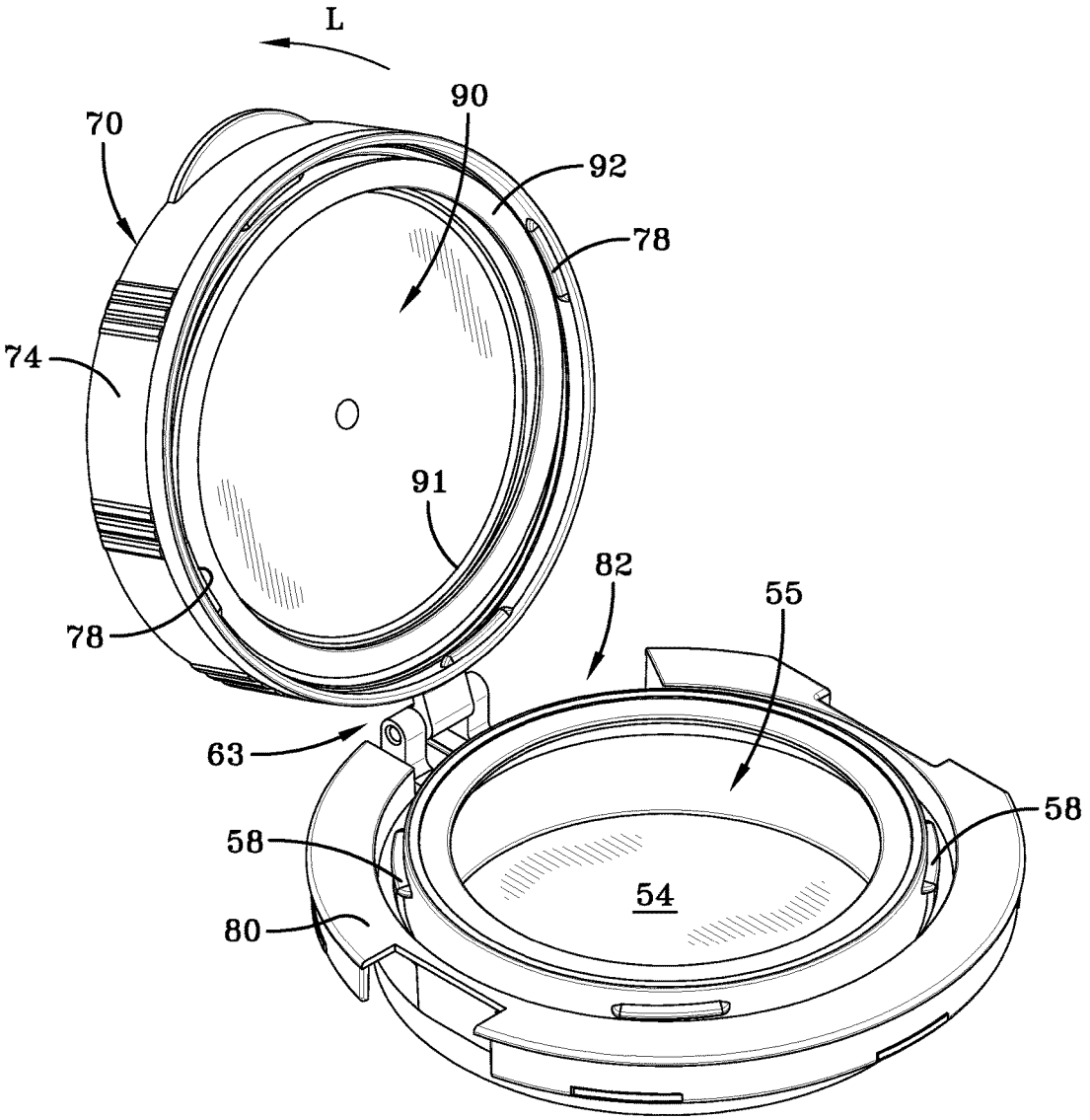
FIG. 11 shows the sealable container of FIG. 10 with the hinged lid lifted to an uncovered, open position.
Figure 12:
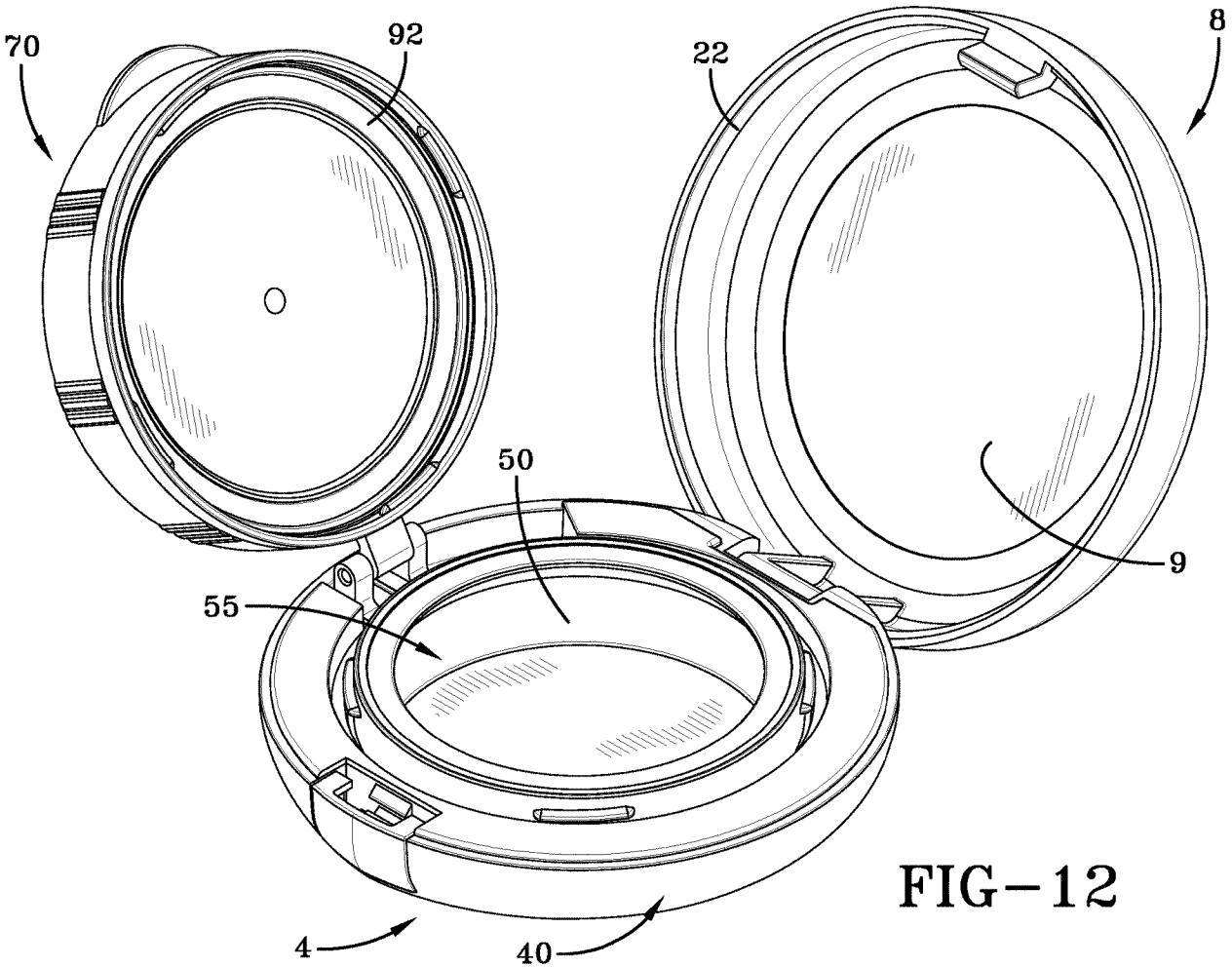
FIG. 12 shows the sealable container of FIG. 11 disposed within the lower base unit of the compact case with the upper cover unit opened.

The hinged ring 60 provides a means for joining the seal cover 70 with the container 50 after the seal cover 70 has been unthreaded from and moved away from the opening of the container 50. As shown in FIGS. 4-6, the hinged ring 60 can be joined to the container 50 by sliding the hinged ring 60 upward from under the container 50, to where the inner rim 69 of the hinged ring 60 engages the side rib 59 of the container 50. In the illustrated embodiment, in one embodiment, the hinged ring 60 is not retained, fixed or secured to the container 50, but when assembled, is held in position axially between the lower base 40 and the container 50, with the container 50 being secured or retainer by the lower base 40. As illustrated, the hinged ring 60 joins the seal cover 70 to the container 50 in a covering position, shown in FIG. 10, and hingedly pivots the seal cover 70 to an uncovered position, shown in FIG. 11, while remaining joined to the container 50. In the uncovered position, the seal cover 70 can pivot away from the opening to the container 50 to permit the user to access the volatile composition within. As shown in FIG. 12, the pivoted-open seal cover 70 does not interfere or engage with the upper cover 22 in its open position.

The wall 62 of the hinged ring 60 has a lower rim 64 and includes an annular inner rim 69 along the lower rim 64 that extends radially inwardly. The inner rim 69 supports the annular side rib 59 of the container 50, as shown in FIGS. 6 and 7. The inner rim 69 provides a lower surface on which the side rib 59 and the container 50 can rotate relative to the inner rim 69 and the hinged ring 60. In the illustrated embodiment, the container 50 is positioned within the hinged ring 60 so that the post 56 is disposed in a gap between a pair of tabs **66*a* and 66*b* that extend radially inwardly from the inner rim 69, which provide rotation stops to limit the angle of rotation of the container 50 within the hinged ring 60. In the illustrated embodiment, the container 50 includes a pair of posts 56, on a direct opposite sides of the container 50, and the hinged ring 60 includes a second pair of the tabs 66*a* and 66*b* directly opposite said first pair of tabs. The pair of tabs 66*a* and 66*b* limit rotation of the seal cover 70, which is rotatably connected to the hinged ring 60, by blocking rotative movement of the post 56 on the container 50, and specifically, limiting rotation of the seal cover 70 on the container 50 between the first rotated position illustrated in FIG. 8 and the second rotated position illustrated in FIG. 9**.

Also illustrated in FIG. 4 is a nub 68 that protrudes radially inwardly from the inner rim 69, and is disposed between the pair of tabs **66*a* and 66*b*, though closer to the tab 66*a* with a space there between. The nub 68 protrudes only a short distance inwardly, to only frictionally interfere with the post 56 as the post 56 and the container 50 are rotated manually by the user either toward or away from the tab 66*a*. The nub 68 sufficiently interferes with the rotative movement of the post 56 to prevent the seal cover 70 from moving incidentally from its first rotated position relative to the container 50, at which the seal cover 70 can be hingedly opened and closed over the opening of the container 50** toward the second rotated position.

As noted above, when the sealable container 6 is inserted down into the opening of the annular frame 42 of the lower base 50, the annular side rib 59 of the container 50 engages and is supported on the upper edge 43 of the frame 42 of the lower base 40. Concurrently, the side rib 59 of the container 50 is also being supported on the inner rib 69 of the hinged ring 60, where the frame 42 will be disposed radially between the lower wall 52 of the container 50 and the inner rib 69 of the hinged ring 60, and the lower rim 64 of the wall 62 of hinged ring 60 is disposed within and can rotate within the annular track 44 of the lower base 40.

Figure 13:
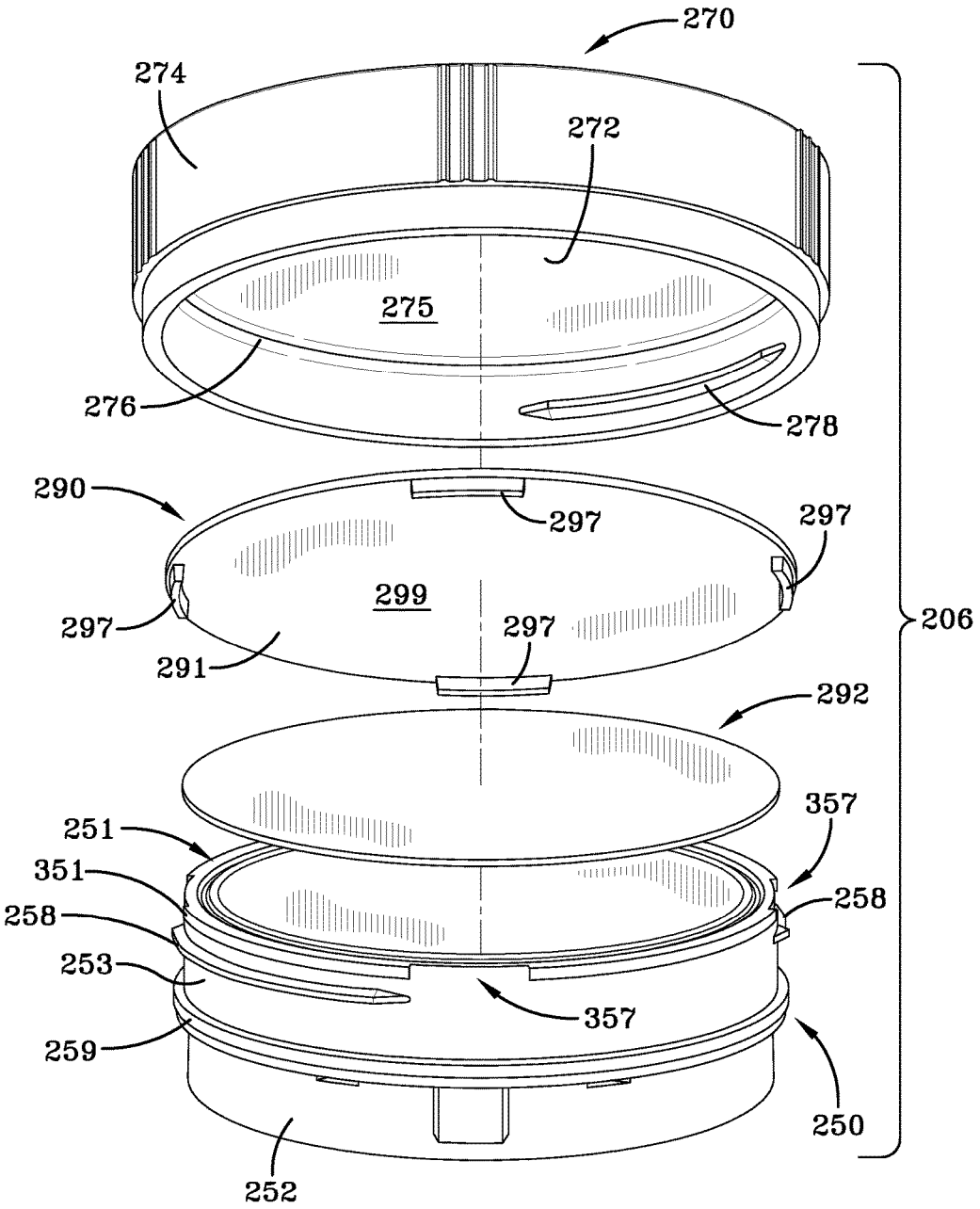
FIG. 13 shows an exploded view of a second embodiment of a replaceable sealable container for a volatile composition.
Figure 14:
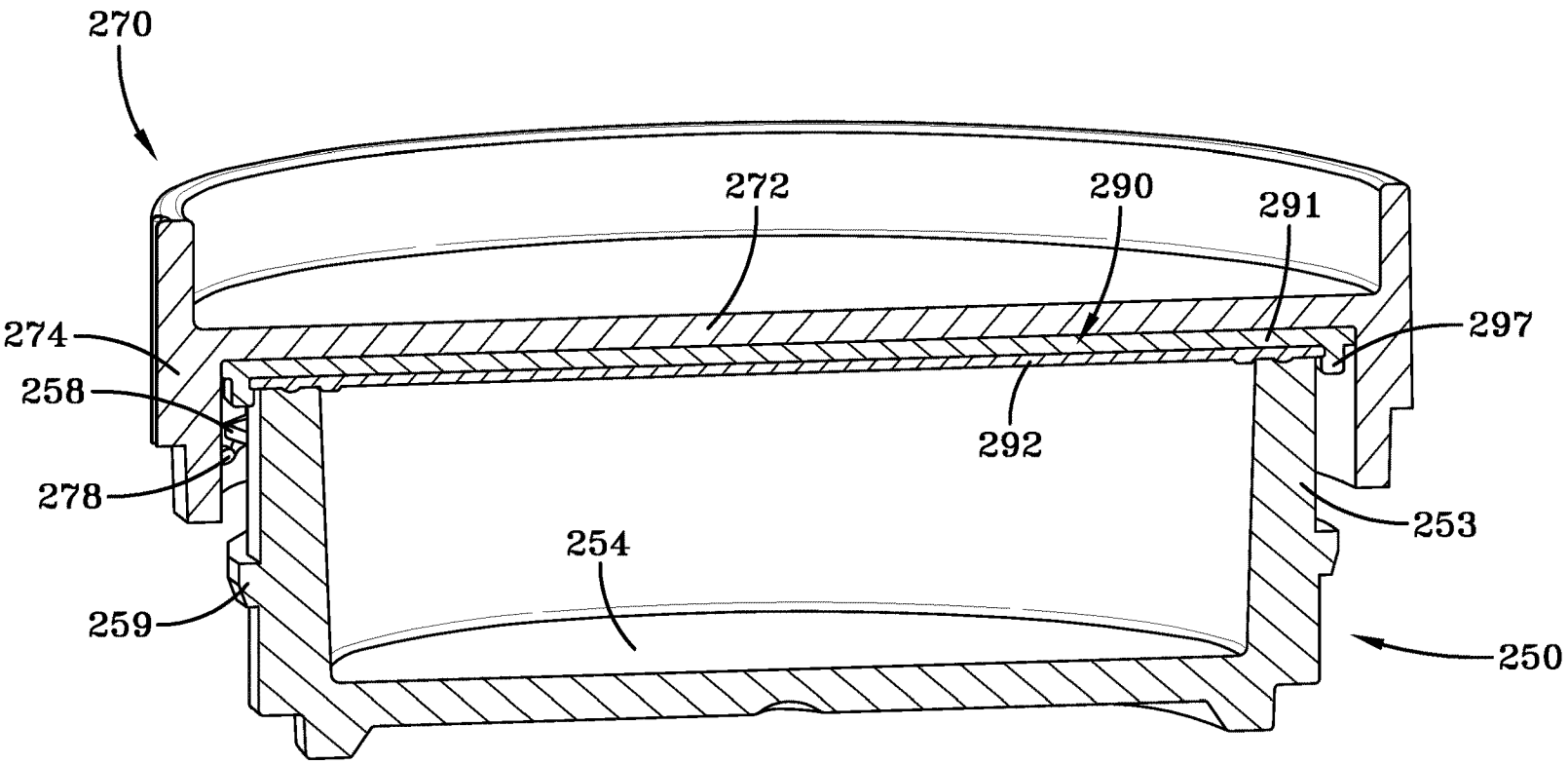
FIG. 14 shows a sectional view of the second embodiment of the sealable container viewed through line 14-14 of FIG. 15.
Figure 15:
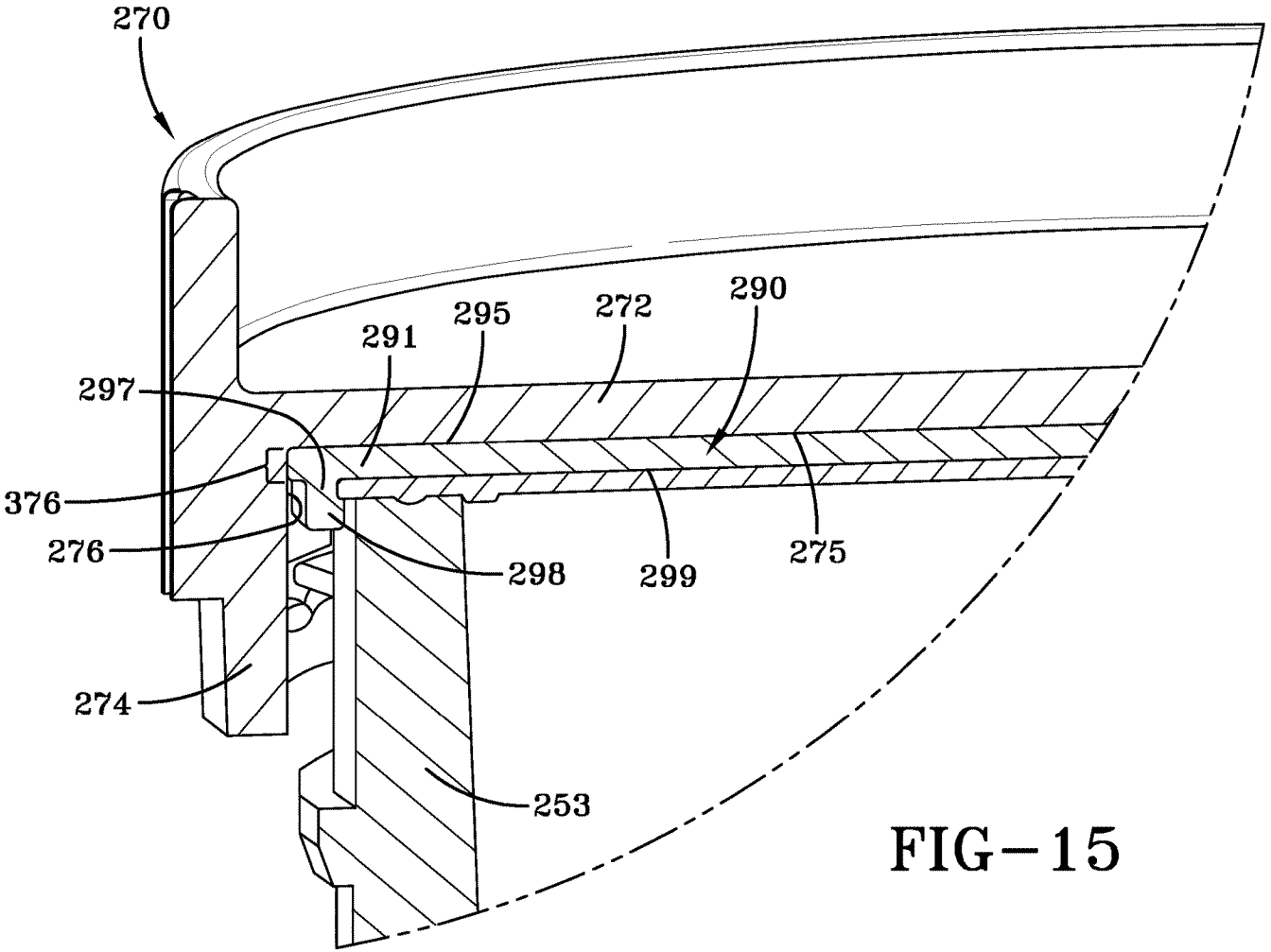
FIG. 15 shows a detailed view of a seal member illustrated in FIG. 14.

FIG. 13-15 illustrate a second embodiment of a replaceable sealable container for a volatile composition. The second embodiment of the sealed container 206 is configured to be replaceable within a compact unit, by insertion and removal from a lower base unit, and to be covered over with an upper cover unit to form a case, as described above in the first embodiment.

The sealed container 206 includes a component container 250 including an annular wall and a bottom, the annular wall including a lower wall 252, an upper wall 253, and annular rib 259 that extends from and separates the lower wall 252 and the upper wall 253. The upper wall 253 includes at least a pair of outwardly-extending thread segments 258 distributed evenly around the circumference of the outside surface of the wall. Each of the thread seer tents 258 align along a helical or slanted path. The container 250 also has a circular upper rim 251 that defines a surface to be closed and sealed by the seal cover 270. The upper rim 251 includes an outer flange 351 that has a plurality of slots 357 along the outside circumference of the flange 351, described further below.

The seal cover or lid 270 is configured to be threadedly secured to the top opening of the container 250 to seal the upper rim 251, substantially as described for the first embodiment. The seal cover 270 includes a cover plate 272 with an inside surface 275 and an outer surface, and an annular wall 274. The annular wall 274 extends downward from the periphery of the cover plate 272. The wall 274 includes at least a pair of inwardly-extending thread segments 278 distributed around the circumference. Each of the thread segments 278 align along a helical or slanted path, to engage thread segments 258 of the container 250 for threadedly sealing the container, as described for the first embodiment. The seal cover 270 also includes an annular inner rib 276 that extends a minimal distance radially inwardly from the inner surface of the wall 274, and a fixed axial distance from the inner surface 275 of the cover plate 272 to define a groove 376 there between, as shown in FIG. 15.

The sealed container 206 comprises a seal system that includes an annular seal disposed between the upper rim 251 of the container 250 and the inside surface 275 of the cover plate 272. The annular seal includes an alternative means for preventing rotative forces comprising an upper seal member 290 having an outer periphery 291, and a lower seal member 292 that registers at least with the outer periphery 291 of an upper seal member 290. The upper seal member 290 is a circular disk, typically made of a resilient thermoplastic material, and the outer periphery 291 of the upper seal member 290 is retained within the groove 376 of the seal cover 270 by the annular inner rib 276, so that the upper seal member 290 remains with the seal cover 270 during product use. The upper seal member 290 also includes a plurality of downwardly projecting segments 297 around the periphery. The projecting segments 297 include an inwardly-projecting ledge 298 (FIG. 14) that offset a distance axially from the under surface 299 of the upper seal member 290 of about the thickness of the lower seal member 292. In an embodiment, the peripheral edge of the lower seal member 292 is retained by the plurality of ledges 298 (FIG. 15).

It can be understood that the second embodiment of the sealable container can comprise the seal system and/or means for preventing rotative force described above for the first embodiment and illustrated in FIGS. 7A and 7B.

When the seal cover 270 is placed over the container 250, the projecting segments 297 of the upper seal member 290 align with and bayonet into a plurality of slots 357 along the circumference of the outer flange 351 of the container 250, to rotatively lock the upper seal member 290 in position over the upper rim 251 of the container 250. As the seal cover 270 is rotated to threadedly draw the inside surface 275 of the plate 272 onto the upper rim 251 of the container, the upper seal member 290 remains stationary, held in place against rotation by the projecting segments 297 disposed in the slots 357. While the inside lower surface 275 of the seal cover 270 slides rotatively over the stationary upper surface 295 of the upper seal member 290, the material of the lower seal member 292, disposed against the upper rim 251 of the container 250, is protected from circumferential shear forces, is prevented from tearing, bunching and deforming.

In the illustrated embodiment, the upper seal member 290 is a circular disk, though in an alternative embodiment can be an annular ring, and is typically made of a resilient thermoplastic material, preferably having low vapor diffusivity.

The components of the sealable container and compact case can be manufactured using well-known and conventional methods, including injection molding and stamping.

We claim:

1. A compact device having a sealable container for a volatile composition, and including:

i) a lower base having an annular frame and an annular track concentric with and surrounding the annular frame;

ii) a container that is securable within the annular frame of the lower base, the container including an annular outer wall, and a floor that define a container space for a volatile composition, and the outer wall having an upper rim, an outer surface and including a series of outwardly-extending thread segments and an annular rib extending from the outer surface of the outer wall;

iii) a hinged ring comprising an annular wall having a lower rim, and a hinge support extending from a portion of said annular wall, and the hinged ring is configured to rotate the lower rim of the annular wall within the annular track of the lower base;

iv) a seal cover including a cover plate and an annular wall having an inner surface and including a series of inwardly-extending thread segments, and a hinge member extending from a portion of said annular wall to hingedly engage the hinge support of the hinged ring to pivot the seal cover between an uncovered position and a covering position, and wherein at the covering position the seal cover is a first rotated position relative to the container, and the seal cover and the hinged ring can be rotated relative to the container, between the first rotated position at which the thread segments of the seal cover are not engaged with the thread segments of the container, and a second rotated position at which the thread segments of the seal cover are engaged with the thread segments of the container to threaded draw the cover plate axially toward the upper rim of the container to a sealing position; and v) an annular seal disposed between the upper rim of the container and the cover plate of the seal cover, for forming a sealable container for the volatile composition when the seal cover is threadedly drawn over the container to the sealing position, the annular seal including an upper seal member having an upper surface and a lower surface having an outer periphery, and a lower seal member that registers within the outer periphery of the lower surface of the upper seal member, and configured to engage the upper rim of the container in the covering position of the seal cover, the upper seal member including a means for preventing rotative force applied to the upper surface of the upper seal member when rotating the seal cover to the second rotated position, to be exerted to the lower seal member.

2. The compact device according to claim 1 wherein the means for preventing rotative force is provided by the upper surface of the upper seal member having high rotative slippage, and/or low rotative friction, between the seal cover and the upper seal member, which prevents the rotating seal cover from rotating the upper seal member, and thereby eliminating any circumferential shear force upon the lower seal member.

3. The compact device according to claim 2 wherein the upper seal member includes an annular flat groove along the outer periphery, and the lower seal member is an annular flattened ring made of a silicon material and configured to reside within the flat groove of the circular disk.

4. The compact device according to claim 3 wherein the upper seal member is made of a thermoplastic material having an upper surface that has a low coefficient of friction.

5. The compact device according to claim 1 wherein the means for preventing rotative force is provided by the upper seal member including a plurality of projections that engage and bayonet into a plurality of slots formed into an annular flange of the upper rim of the container, to prevent the rotating seal cover from rotating the upper seal member, and thereby eliminating any circumferential shear force upon the lower seal member.

6. The compact device according to claim 1 wherein the lower base includes an annular inner tray disposed outerward radially of the hinged ring, the inner tray having a slot within which the hinge support of the hinged ring can rotate relative to the container between the first rotated position and the second rotated position.

7. The compact device according to claim 1 further including an upper outer cover that is hinged to the lower base, to cover the sealable container.

8. The compact device according to claim 1 wherein the lower base, the container, the hinged ring, the seal cover, and the annular seal each have a rotative centerline that align with a common centerline.

9. The compact device according to claim 1 wherein the series of outwardly-extending thread segments are a separated by a corresponding series of gaps, wherein the series of inwardly-extending thread segments of the seal cover are angularly aligned with series of gaps when the seal cover is in the covering position, and the seal cover and the hinged ring are in the first rotated position relative to the container, and are angularly aligned with the series of outwardly-extending thread segments when the seal cover and the hinged ring are in the second rotated position relative to the container.

10. A sealable container for a volatile composition, including:

i) a container including an annular outer wall, and a floor that define a container space for a volatile composition, and the outer wall having an upper rim and an outer surface, and the outer wall including a series of outwardly-extending thread segments on the outer surface;

ii) a hinged ring comprising an annular wall having a lower rim, and a hinge support extending from a portion of said annular wall, and the hinged ring is configured to rotate relative to the container;

iii) a seal cover including a cover plate and an annular wall having an inner surface, the annular wall including a series of inwardly-extending thread segments on the inner surface, and a hinge member extending from a portion of said annular wall to hingedly engage the hinge support of the hinged ring to pivot the seal cover between an uncovered position and a covering position, and wherein at the covering position the seal cover is a first rotated position relative to the container, and the seal cover and the hinged ring can be rotated relative to the container, between the first rotated position at which the thread segments of the seal cover are not engaged with the thread segments of the container, and a second rotated position at which the thread segments of the seal cover are engaged with the thread segments of the container to threaded draw the cover plate axially toward the upper rim of the container to a sealing position; and iv) an annular seal disposed between the upper rim of the container and the cover plate of the seal cover, for forming a sealable container for the volatile composition when the seal cover is threadedly drawn over the container to the sealing position, the annular seal including:

a) an upper seal member having an upper surface and a lower surface having an outer periphery, and b) a lower seal member that registers within the outer periphery of the lower surface of the upper seal member, wherein the lower seal member is made of a pliable material selected from the group consisting of a silicon material, a urethane material, and a rubber or nitrile rubber material, which can elastically conform to a seal surface of the upper rim of the container and the upper seal member, wherein the annular seal includes a means for preventing a rotative force that is applied to the upper surface of the upper seal member when rotating the seal cover to the second rotated position, from being exerted as a circumferential shear force onto the lower seal member, and wherein the means for preventing rotative force is selected from the group consisting of:

(1) the upper surface of the upper seal member having high rotative slippage, and/or low rotative friction, and (2) a slippage sheet disposed between the upper surface of the upper seal member and the seal cover, the slippage sheet comprising a slippage material or surface coating having high rotative slippage and low rotative friction.

11. The compact device according to claim 10 wherein the means for preventing rotative force is the upper surface of the upper seal member having high rotative slippage, and/or low rotative friction.

12. The compact device according to claim 11 wherein the upper seal member is made of a thermoplastic material having an upper surface that has a low coefficient of friction.

13. The compact device according to claim 11 wherein the upper seal member includes an annular flat groove along the outer periphery, and the lower seal member is an annular flattened ring made of a silicon material and configured to reside within the flat groove of the circular disk.

14. The compact device according to claim 13 wherein the upper seal member is made of a thermoplastic material having an upper surface that has a low coefficient of friction.

15. The compact device according to claim 10 wherein the series of outwardly-extending thread segments of the container are a separated by a corresponding series of gaps, and wherein the series of inwardly-extending thread segments of the seal cover are angularly aligned with the series of gaps when the seal cover is in the covering position and the seal cover and the hinged ring are in the first rotated position relative to the container, and wherein the series of inwardly-extending thread segments of the seal cover are angularly aligned with the series of outwardly-extending thread segments of the container when the seal cover and the hinged ring are in the second rotated position relative to the container.

16. The compact device according to claim 10 wherein the means for preventing rotative force is the slippage sheet disposed between the upper surface of the upper seal member and the seal cover.

17. A sealable container for a volatile composition, including:

i) a container including an annular outer wall, and a floor that define a container space for a volatile composition, and the outer wall having an upper rim, an outer surface and including a series of outwardly-extending thread segments;

ii) a seal cover including a cover plate and an annular wall having an inner surface and including a series of inwardly-extending thread segments, the seal cover having a first rotated position relative to the container at which the thread segments of the seal cover are not engaged with the thread segments of the container, and a second rotated position at which the thread segments of the seal cover are engaged with the thread segments of the container to threaded draw the cover plate axially toward the upper rim of the container to a sealing position; and iii) an annular seal disposed between the upper rim of the container and the cover plate of the seal cover, for forming a sealable container for the volatile composition when the seal cover is threadedly drawn over the container to the sealing position, the annular seal including:

a), an upper seal member having an upper surface and a lower surface having an outer periphery, and b) a lower seal member that registers within the outer periphery of the lower surface of the upper seal member, wherein the lower seal member is made of a pliable material selected from the group consisting of a silicon material, a urethane material, and a rubber or nitrile rubber material, which can elastically conform to a seal surface of the upper rim of the container and the upper seal member, wherein the annular seal includes a means for preventing a rotative force that is applied to the upper surface of the upper seal member when rotating the seal cover to the second rotated position, from being exerted as a circumferential shear force onto the lower seal member, and wherein the means for preventing rotative force is selected from the group consisting of:

(1) the upper surface of the upper seal member having high rotative slippage, and/or low rotative friction, and (2) a slippage sheet disposed between the upper surface of the upper seal member and the seal cover, the slippage sheet comprising a slippage material or surface coating having high rotative slippage and low rotative friction.

18. The compact device according to claim 17 wherein the means for preventing rotative force is the upper surface of the upper seal member having high rotative slippage, and/or low rotative friction.

19. The compact device according to claim 18 wherein the upper seal member includes an annular flat groove along the outer periphery, and the lower seal member is an annular flattened ring made of a silicon material and configured to reside within the flat groove of the circular disk.

20. The compact device according to claim 17 wherein the means for preventing rotative force is the slippage sheet disposed between the upper surface of the upper seal member and the seal cover.

* * * * *